US005878846A

United States Patent [19]

O'Donnell

[11] Patent Number: 5,878,846

[45] Date of Patent: Mar. 9, 1999

[54] LIGHT DUTY ELEVATOR DOOR OPERATOR

[75] Inventor: Timothy P. O'Donnell, Delray Beach, Fla.

[73] Assignee: Vertisys, Inc., Boca Raton, Fla.

[21] Appl. No.: 726,780

[22] Filed: Oct. 7, 1996

[51] Int. Cl.[6] ..... B66B 13/06

[52] U.S. Cl. ..... 187/318; 187/324; 187/334

[58] Field of Search ..... 187/313, 315, 187/324, 334, 318; 49/116, 118, 123

[56] References Cited

U.S. PATENT DOCUMENTS

| | | | |
|---|---|---|---|
| 1,934,867 | 11/1933 | Lindstrom et al. | 187/280 |
| 2,363,929 | 11/1944 | Banks et al. | 187/324 |
| 2,534,596 | 12/1950 | Harmon | 187/318 |
| 2,905,463 | 9/1959 | Borden | 187/324 |
| 3,872,622 | 3/1975 | Berk | 49/118 |
| 4,050,191 | 9/1977 | Azuma | 49/123 |
| 4,149,615 | 4/1979 | Kappenhagen | 187/324 |
| 4,357,998 | 11/1982 | Gibson et al. | 187/314 |
| 5,213,182 | 5/1993 | Guckert et al. | 187/315 |
| 5,701,973 | 12/1997 | Tracey | 187/315 |

FOREIGN PATENT DOCUMENTS

| | | | |
|---|---|---|---|
| WO 93/23324 | 11/1993 | Italy | 187/324 |
| 2-81888 | 3/1990 | Japan | 187/324 |
| 3-264486 | 11/1991 | Japan . | |

*Primary Examiner*—William E. Terrell
*Assistant Examiner*—Patrick Mackey
*Attorney, Agent, or Firm*—Brooks & Kushman P.C.

[57] ABSTRACT

An elevator car door operator includes a drive motor, a drive pulley mounted for rotation by the drive motor, a continuous loop drive belt mounted on the drive pulley at one end of the belt and on an idler pulley at the other end of the belt, a drive bar connected to the drive belt and slidably mounted on a bar guide for translational movement across the elevator car door header. One or more doors are slidably mounted on guide tracks for movement between open and closed positions. One of the doors is either connected directly to the drive bar, or connected to a two-to-one relating cable mounted on the drive bar, so that the motion of the drive bar is transmitted to that door, thereby slidably positioning the door as the drive bar is slidably positioned by the belt along the length of the bar guide.

7 Claims, 5 Drawing Sheets

LIGHT DUTY ELEVATOR DOOR OPERATOR

TECHNICAL FIELD

This invention relates to a simple, compact, economical elevator door operator for elevators designed for limited use.

The typical objectives in designing elevators, and more particularly, elevator door operator systems, include a sufficient ruggedness and reliability to withstand constant, heavy usage, a design that is sufficiently compact to fit within the elevator hoistway, and a system design and components which are readily serviceable. A number of elevator door operating systems generally meeting these design objectives are commercially available.

However, there is a need for a simpler, more economical elevator door operator for an elevator system that is designed for light duty, that is, limited access and limited use, such as for use solely to accommodate handicap persons unable to use stairways in multiple story buildings. Since these light duty elevators are being installed in existing buildings that were not originally designed to accommodate elevator systems, there is an increased need for compactness.

SUMMARY OF THE INVENTION

It is therefore an object of the present invention to provide a door operator for a limited use elevator which is inexpensive and easy to install.

It is another object of the present invention to provide a door operator for a limited use elevator which is compact enough to allow for installation in existing buildings.

It is another object of the present invention to provide a door operator for a limited use elevator which is simple in design and contains relatively few components to facilitate ease of service.

It is yet another object of the present invention to provide a compact, lightweight DC motor, belt-driven door operator for a two-speed side opening car door configuration.

It is yet another object of the present invention to provide a door operator driven by a DC motor which is powered by a standard 110 volt AC electrical circuit.

In carrying out the above and other objects, the car door operator of this invention includes a drive motor, a drive pulley mounted for rotation by the drive motor, a continuous loop drive belt mounted on the drive pulley at one end of the belt and on an idler pulley at the other end of the belt, a drive bar connected to the drive belt and slidably mounted on a bar guide for translational movement across the elevator car door header. One or more doors are slidably mounted on guide tracks for movement between open and closed positions. One of the doors is either connected directly to the drive bar, or connected to a relating cable mounted on the drive bar, so that the motion of the drive bar is transmitted to the door, thereby slidably positioning the door as the drive bar is slidably positioned by the belt along the length of the bar guide. In two-door configurations, a second door is connected to the operator via a suitable relating cable to slidably position the second door from an open to close position and vice-versa.

In one two-speed car door configuration, the first door is connected directly to the drive bar for positioning as described above, and the second door is connected to a two-to-one relating cable which is looped around relating pulleys mounted on the drive bar. The relating cable is also secured to the header, so that, as the drive bar is slidably positioned along the bar guide, the relating cable, and thus the second door, moves relative to the drive bar, thereby resulting in a faster motion of the second door relative to the first door as the doors are driven simultaneously in the same direction towards the desired (opened or closed) position.

In another embodiment employing a center opening door configuration, the first door is connected to the two-to-one relating cable, via a suitable cable bracket, for positioning rather than to the drive bar as described above. The first door is also connected to a relating cable which is looped about a pair of pulleys and connected to the second door to thereby transmit the driven movement of the first door in an equal but opposite speed and direction.

It will be appreciated that the design of the present invention provides for an elevator door operator which is simple and compact, allowing for installation in existing buildings where a limited use elevator is required, but space for the elevator is limited. In one embodiment, the elevator operator assembly requires as little as about 14 inches of clearance above the elevator door height and, where the two-speed configuration is employed, limited width requirements (equal to approximately the width of the elevator plus one of the doors).

These and other objects, features, and advantages of the present invention are readily apparent from the following detailed description of the best mode for carrying out the invention, when taken in connection with the accompanying drawings.

BEST MODE FOR CARRYING OUT THE INVENTION

Figure 1:
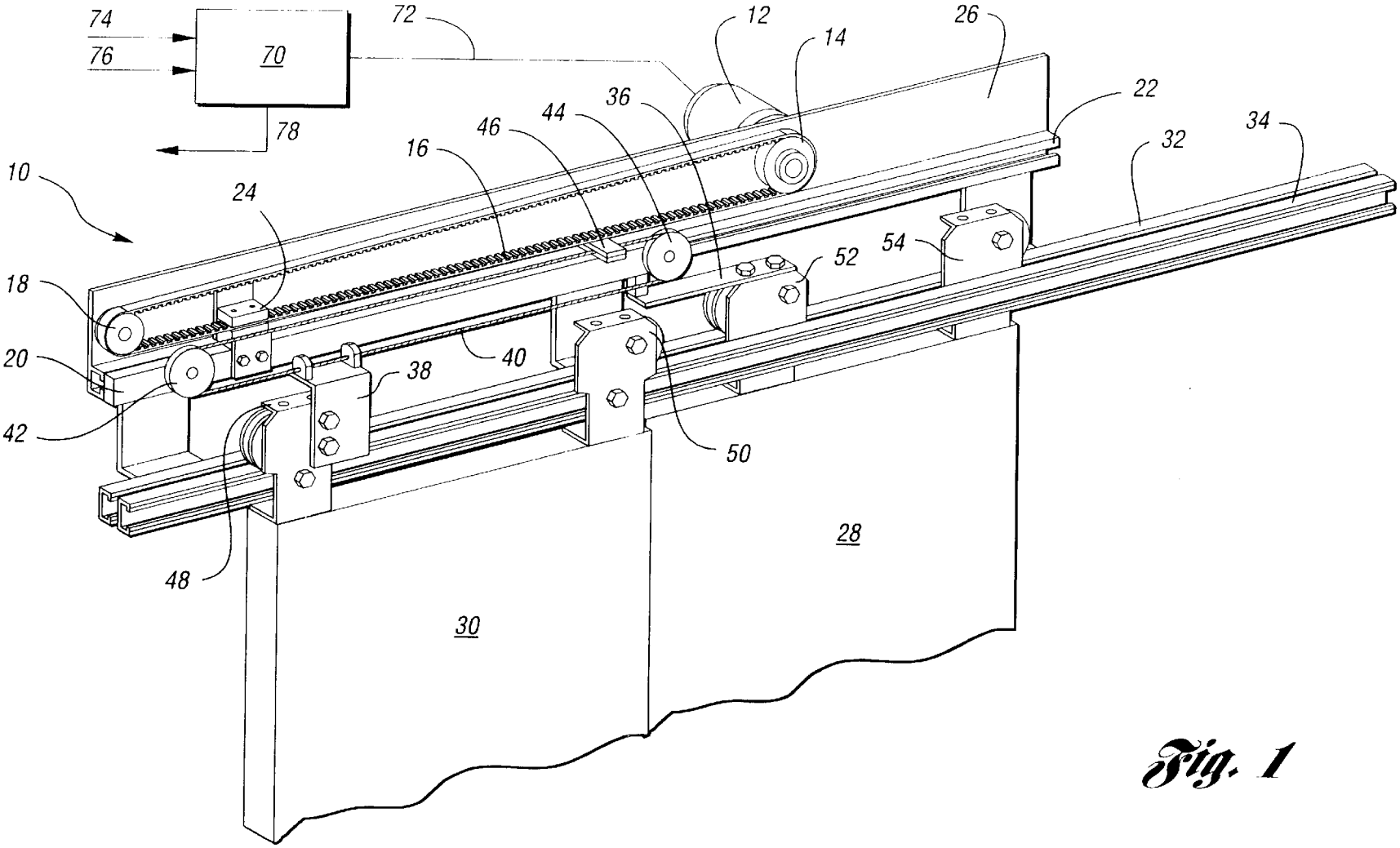
FIG. 1 is a perspective view of a two-speed door operator of the present invention showing the elevator doors in a closed position.
Figure 2:
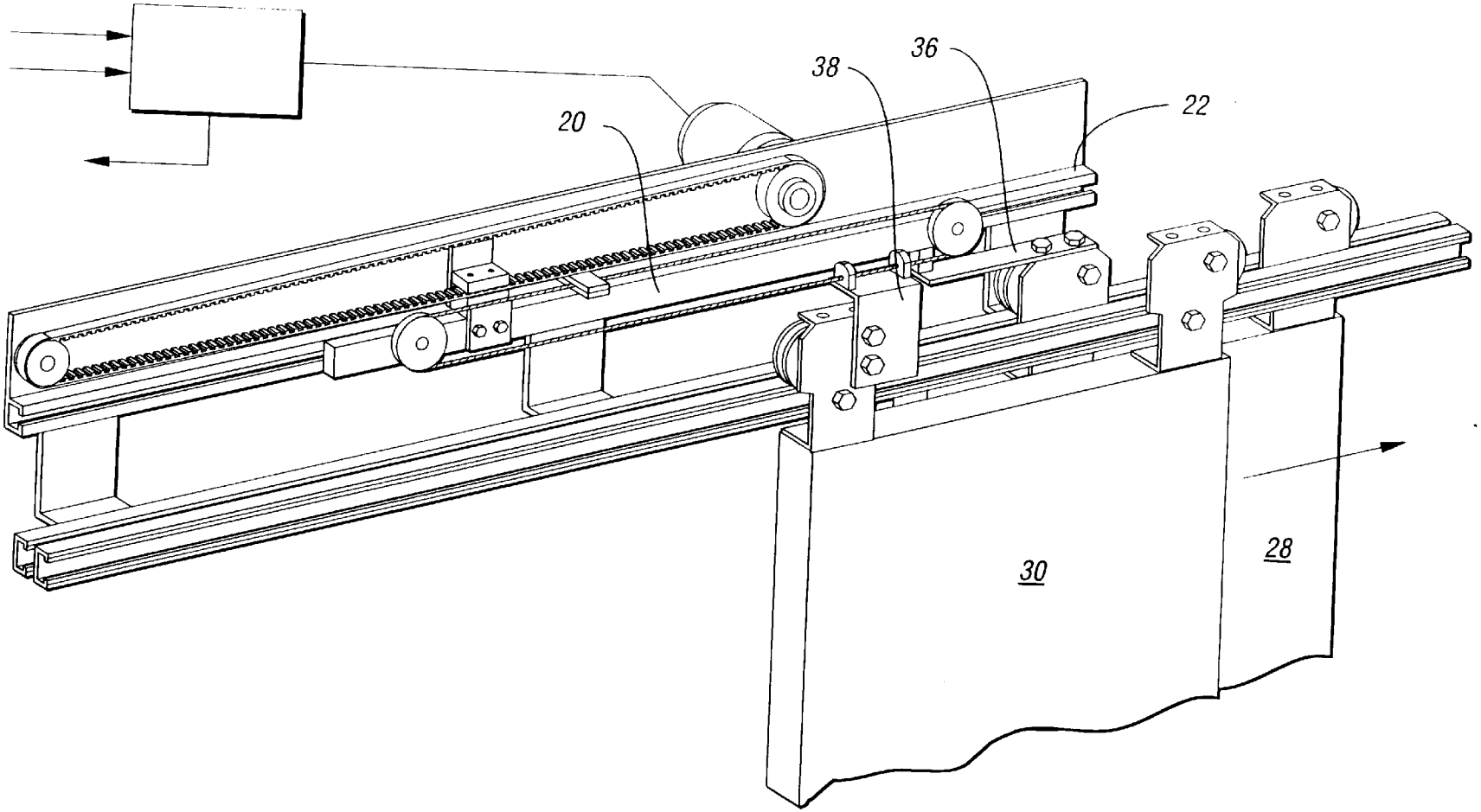
FIG. 2 is a perspective view of the embodiment of FIG. 1 showing the elevator doors in an open position.

Referring to FIGS. 1 and 2, the car door operator of the present invention, generally designated as 10, includes a drive motor 12, a drive pulley 14 mounted for rotation by the drive motor, a continuous loop drive (or cog) belt 16 looped on the drive pulley 14 at one end, and around an idler pulley 18 at the other end, and a drive bar 20 slidably mounted on a bar guide 22 for translational movement across the elevator car door opening. The drive bar 20 is connected, via linkage 24, to the drive belt 16 so that the motion of the drive belt is directly transmitted to the sliding drive bar 20.

The above-described assembly is mounted on a framework that is stationary with respect to the elevator car such as, preferably, a header 26. One or more doors 28, 30, are slidably mounted on guide tracks 32, 34 for movement between open and closed positions. The guide tracks 32-34 are also mounted in a fixed position relative to the elevator car. One of the doors 28, hereafter referred to as the first door, is connected directly to the drive bar 20 via bracket 36 so that the motion of the sliding drive bar is directly transmitted to the door, thereby positioning the door as the drive bar is slidably positioned along the length of the bar guide 22 by the moving drive belt 16. The second door 30 is connected to the operator via a suitable relating cable so that the second door 30 is slidably positioned as a result of the movement of the cable.

In the embodiment illustrated in FIGS. 1 and 2, the door opener is a two-speed configuration wherein the second door 30 is moved in the same direction as the first door 28 at a relatively faster speed. This is accomplished by connecting the second door via bracket 38 to a relating cable 40. The relating cable 40 is looped around a pair of relating pulleys 42 and 44 which are mounted on the moving drive bar 20. The relating cable 40 is also secured to the header 26, via linkage 46 so that, as the drive bar 20 slides on the bar guide 22, the cable is repositioned relative to the moving drive bar 20.

It will thus be appreciated that, by securing the upper portion of the relating cable to the stationary header, and connecting the second door 30 to the lower portion of the relating cable loop, the second door 30 is moved both as a result of the translation of the drive bar 20 and the relating cable 40, resulting in a relatively faster same direction positioning of the second door 30 with respect to the first door 28. It will also be appreciated that this two-speed configuration provides the advantage of limited width requirements for installation of the elevator, since an opening equal to roughly the width of the elevator plus the width of one door would be required for this configuration.

The elevator doors 28, 30 are preferably hung for slidable positioning via conventional hangers 48–54. The guide tracks 32, 34, door header 26, drive bar 20, and bar guide 22 may be fabricated from any suitable structural material, such as steel or aluminum alloy, as dictated by the weight and load requirements of the elevator. It will be appreciated, however, that where the door operator is employed in a limited use/limited access elevator, as many structural components as possible and, preferably, the drive bar, bar guide and sliders, are fabricated from relatively lighter aluminum alloys to provide the required strength at reduced weight (and, therefore, reduced operating costs).

From one embodiment, the drive motor is a low-voltage DC geared motor and, preferably, a permanent magnet field 12 volt DC geared motor, such as Model No. VO7359AB89 available from Von Weise, Inc., of St. Clair, Mo.

The drive pulley 14 preferably includes teeth which mesh with the teeth in the cog belt 16 to smoothly and accurately drive the belt. The drive pulley is mounted, preferably along with a suitable torque limiter, on the drive shaft of the drive motor, so that excess torque is not transmitted to the operator drive assembly.

Figure 3:
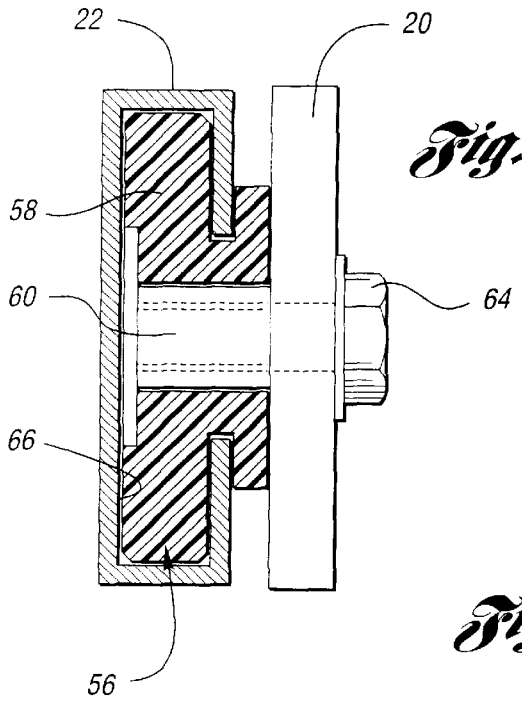
FIG. 3 is a side view in cross-section of the drive bar, slider assembly, and bar guide.
Figure 4:
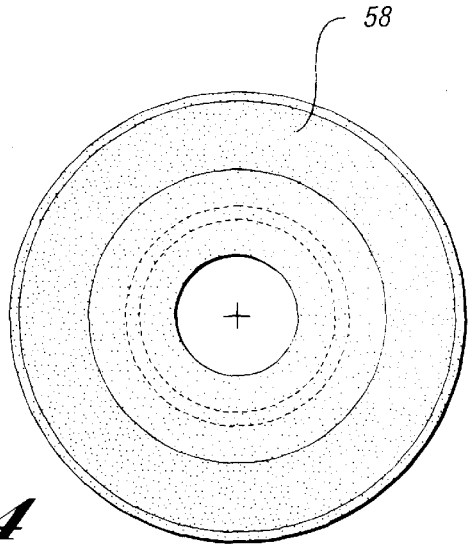
FIG. 4 is a front view of the slider wheel.
Figure 5:
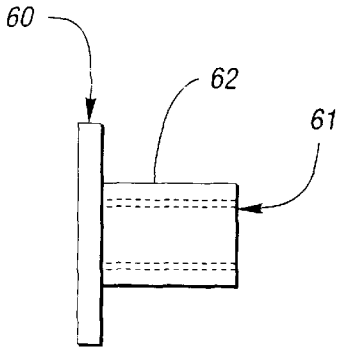
FIG. 5 is a side view of the slider retainer.

Referring to FIGS. 3–5, the drive bar 20 is connected to the bar guide 22 in one embodiment by a plurality of slider assemblies 56 which include a wheel 58 and a retainer 60. The bar guide has a generally C-shaped cross-section 22. The wheel 58 of the slider assembly 56 is of a sufficient diameter to roll within the channel of the bar guide without excessive play. The retainer 60 is adapted to be fitted in the hole in the wheel 58 to extend outwardly through the opening of the C-shaped bar guide 22. The retainer 60 preferably has an internal thread 61 on its shaft 62 so that it can be connected to the drive bar 20 by a threaded connector 64 such as a conventional screw.

A plurality of slider assemblies 56 are mounted within the bar guide 22 and secured in this manner along the length of the drive bar 20. While the number of slider assemblies 56 is dependent upon the length of the drive bar 20 and bar guide, which, in turn, is dictated by the extent of desired travel of the elevator door, it has been found preferable to mount slider assemblies 56 on the drive bar 20 within the bar guide 22 spaced apart at about 18 inches.

The retainer shaft and bar guide channel 66 are both preferably surface treated with a known "hard lube" anodizing treatment to harden as well as lubricate the contact surfaces of this assembly. The bar guide is preferably fabricated from an aluminum alloy, such as aluminum 6061-T5. The slider wheel 58 is preferably fabricated from a resilient plastic, such as Delrin.

The door operator of the present invention is preferably controlled by a suitably programmed microprocessor control 70 which outputs an electrical signal 72 to drive the DC motor in the desired speed and direction on the basis of input 74 received from position sensors (not shown) mounted to detect the positions of the elevator doors 28 and 30. The position sensors may be any of a variety of commercially available induction sensors, mounted, for example, on the header to sense the position of the doors as they move underneath the bar guide. The other input 76 to the control 70 is from an induction flag mounted on the linkage 24 which unites the belt. The control 70 may also provide output 78 to a separate elevator car controller (not shown) as desired.

Figure 6:
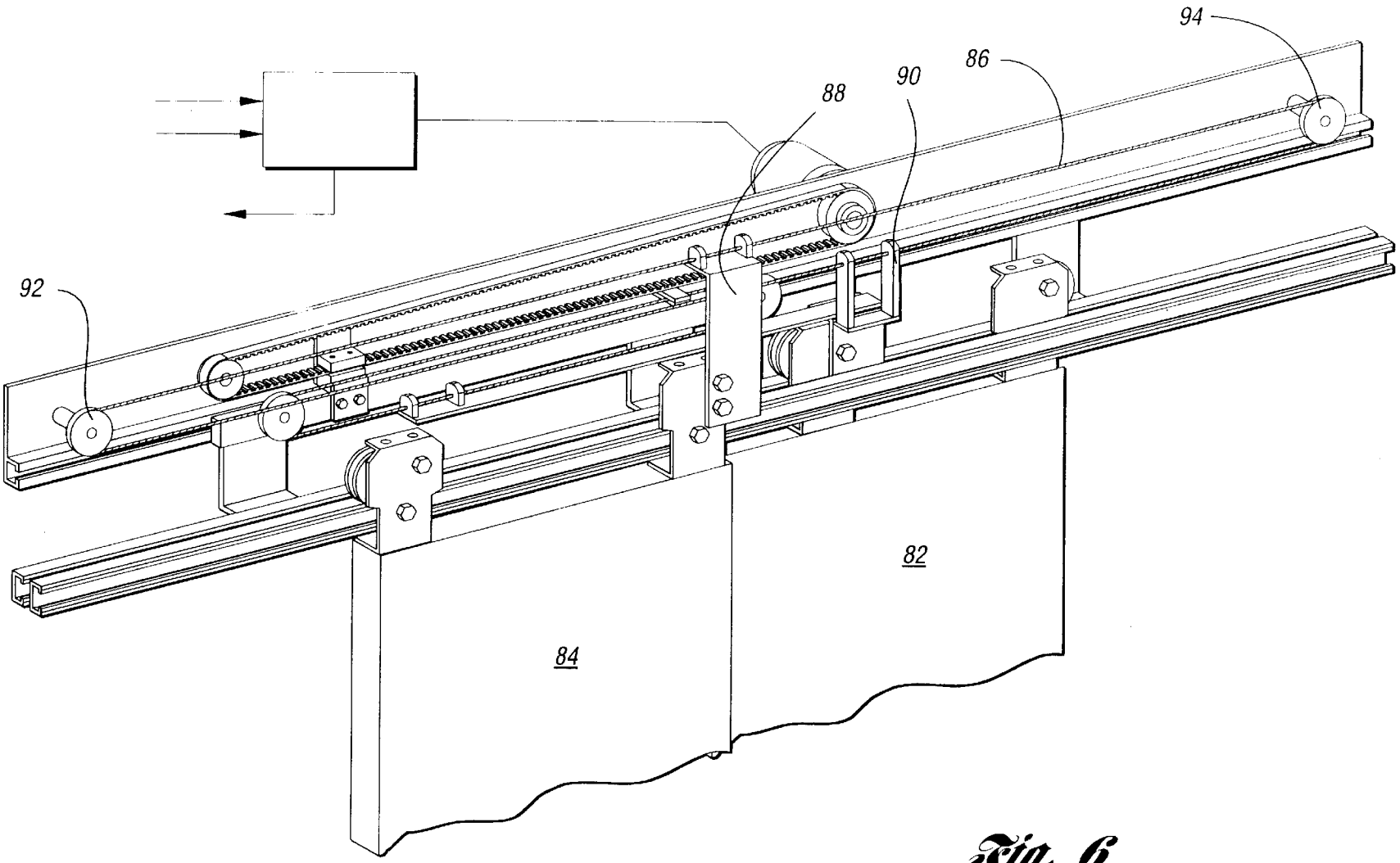
FIG. 6 is a perspective view of another embodiment of the present invention employing a center opening door configuration showing the elevator doors in a closed position.
Figure 7:
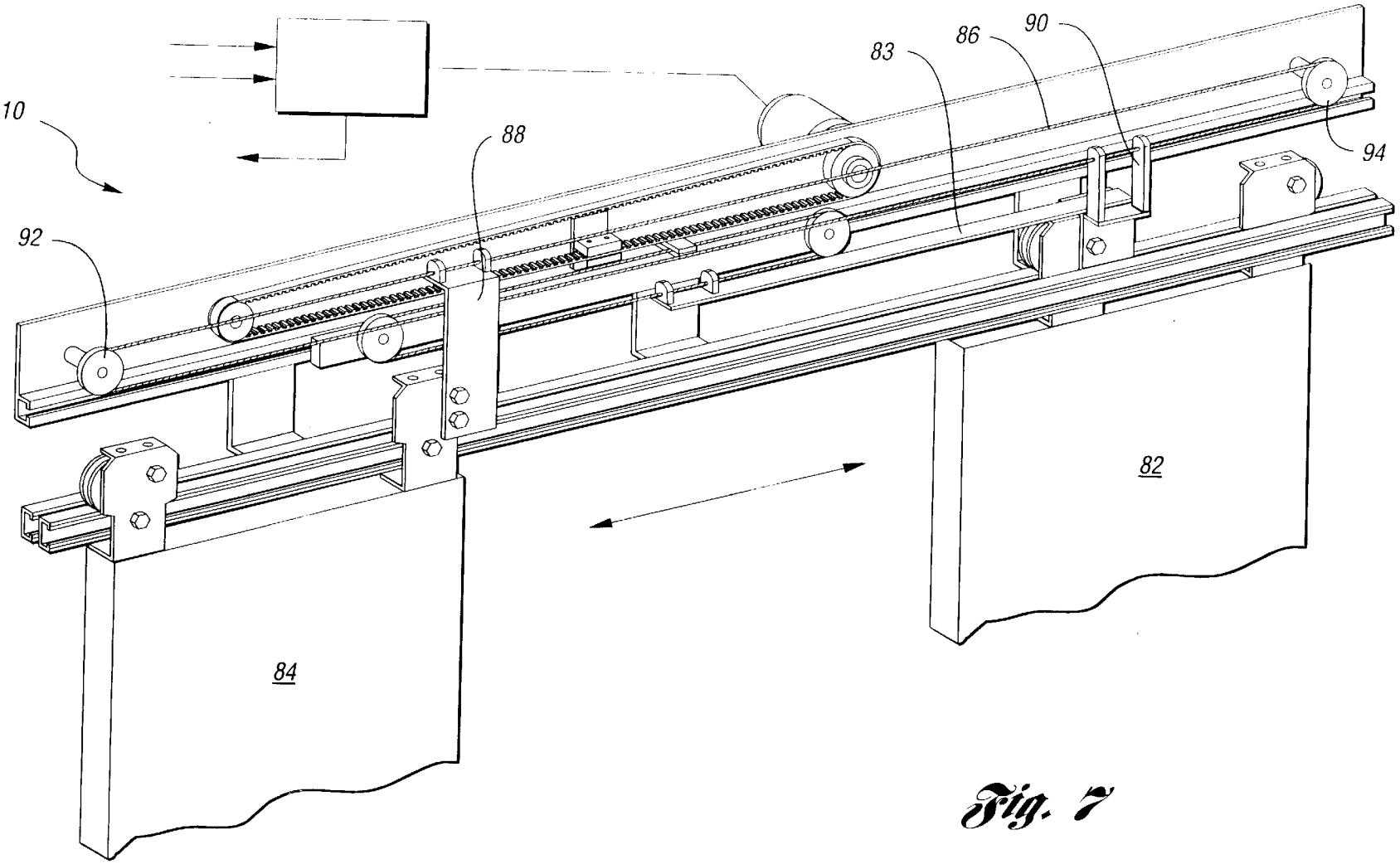
FIG. 7 is a perspective view of the embodiment of FIG. 6 showing the elevator doors in an open position; and, FIG. 8 is a side view of the upper portion of the operating system of the present invention.

Another embodiment of the elevator door operator of the present invention is shown in the center-opening configuration illustrated in FIGS. 6 and 7. In this embodiment, the drive motor, drive pulley, cog belt, idler pulley, drive bar, bar guide and two-to-one relating cable assembly remain the same as shown in FIG. 1 and described above. To achieve a center-opening operation in which the doors move away from each other to open and towards each other to close, the first door 82 is connected to the two-to-one relating cable via cable bracket 83. The second door 84 is drivingly connected to the first door 82 via relating cable 86 via cable bracket 88. The first door is also connected to relating cable 86 via cable bracket 90 so that the translation of the first door in one direction drives the cable on pulleys 92, 94 to move the second door at the same speed in the opposite direction.

It will also be appreciated that the door operator of the present invention may be utilized with other elevator door configurations to provide a simple, lightweight, low-cost door operator for limited use applications. For example, the embodiment illustrated in FIG. 1 could be modified to operate a telescoping door configuration including a first, directly-driven door connected to the drive bar 20 in the manner similar as door 28, one or more intermediate doors mounted on intermediate guide tracks, and a high-speed door connected to a relating cable in the manner similar to door 30 of FIG. 1, so that the intermediate doors are pushed or pulled by the high-speed door as the door is positioned by the operator.

Figure 8:
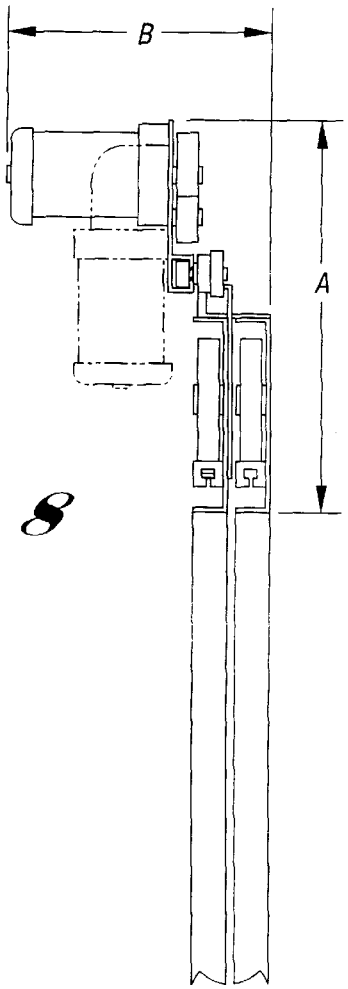

As shown in FIG. 8, the door operator of the present invention has a relatively compact profile, requiring a limited space "A" above the doors for a particular installation. In one embodiment, this space "A", is as small as 14 inches. In addition, the drive motor may alternatively be mounted in a transverse relationship to the drive axle (shown in phantom) to further reduce the "B" clearance requirements.

While the best mode for carrying out the invention has been described in detail, those familiar with the art to which this invention relates will recognize various alternative designs and embodiments for practicing the invention as disclosed by the following claims.

What is claimed is:

1. An elevator door operator for use in an elevator, including an elevator car having a header plate, one or more car door guide tracks mounted in a fixed position relative to the car, and at least two doors slidably mounted on the door track, the door operator comprising:

a drive motor;

a drive pulley mounted in a fixed position relative to the car for driving rotation by the drive motor;

an idler pulley also mounted in a fixed position relative to the car;

a continuous loop drive belt mounted on the drive pulley at one end of the belt and on an idler pulley at the other end of the belt;

an elongate bar guide mounted in a fixed position relative to the car;

drive bar slidably mounted on the bar guide for translational movement across the door header;

a linkage connecting the drive bar to the drive belt;

a connector for joining a first one of the doors to the drive bar, whereby the motion of the drive bar is directly transmitted to the first door to position the door as the drive bar is slidably positioned by the belt along the length of the bar guide;

a pair of spaced apart relating pulleys mounted in a fixed position relative to the drive bar;

a continuous loop relating cable mounted on the relating pulleys;

a linkage connecting the relating cable in a fixed position on the header; and a cable hitch for joining a second one of the doors to the relating cable, whereby the motion of the drive bar relative to the elevator car is indirectly transmitted to the second door, and the motion of the relating cable relative to the drive bar is directly transmitted to the second door, to position the second door as the drive bar is slidably positioned by the belt along the length of the bar guide.

2. The elevator door operator of claim 1 wherein the elevator car has one door and wherein the drive connector comprises a pair of spaced apart relating pulleys mounted in a fixed position relative to the drive bar;

a continuous loop relating cable mounted on the relating pulleys;

a linkage connecting the relating cable in a fixed position relative to the car; and a cable hitch for joining the door to the relating cable, whereby the motion of the drive bar relative to the elevator car and the motion of the relating cable relative to the drive bar are both transmitted to the door to position the door as the drive bar is slidably positioned by the belt along the length of the bar guide.

3. The elevator door operator of claim 1 wherein the bar guide and retainer are fabricated from an aluminum alloy.

4. The elevator door operator of claim 1 further including a torque limiter mounted on the drive shaft of the drive motor to limit the transmission of excess torque to the drive pulley.

5. The elevator door operator of claim 1 further including a plurality of slider assemblies, each slider assembly including a wheel and retainer, and wherein the bar guide has a generally C-shaped cross section and the wheel of each slider assembly is of sufficient diameter to roll within the channel of the bar guide defined by the C-shaped cross section, and wherein the drive bar is secured to the retainer of each of the slider assemblies, thereby slidably connecting the drive bar to the bar guide.

6. The elevator door operator of claim 5 wherein the wheel on the slider assemblies is made of a resilient plastic.

7. An elevator door operator for use in an elevator including an elevator car having a header plate, one or more car door guide tracks mounted in a fixed position relative to the car, and two car doors slidably mounted on the car door guide tracks, the door operator comprising:

a drive motor;

a drive pulley mounted in a fixed position relative to the car for driving rotation by the drive motor;

an idler pulley also mounted in a fixed position relative to the car;

a continuous loop drive belt mounted on the drive pulley at one end of the belt and on an idler pulley at the other end of the belt;

an elongate bar guide mounted in a fixed position relative to the car;

a drive bar slidably mounted on the bar guide for translational movement across the door header;

a linkage connecting the drive bar to the drive belt;

a pair of spaced-apart relating pulleys mounted in a fixed position relative to the drive bar;

a continuous loop two-to-one relating cable mounted on the relating pulleys;

a linkage connecting the relating cable in a fixed position on the header;

a connector for joining a first one of the doors to the two-to-one relating cable, whereby the motion of the drive bar is indirectly transmitted to the first door to position the door as the drive bar is slidably positioned by the belt along the length of the bar guide;

a second pair of spaced-apart relating pulleys mounted in a fixed position relative to the elevator car;

a continuous loop relating cable mounted on the second pair of relating pulleys;

a cable hitch for joining the first door to the relating cable, whereby the motion of the first door relative to the elevator car is transmitted to the relating cable;

a cable hitch for joining the second door to the relating cable, whereby the motion of the relating cable is transmitted to the second door to move the second door in a direction opposite to the motion of the first door as the drive bar is slidably positioned by the belt along the length of the bar guide.

* * * * *